United States Patent [19]

Mayer

[11] Patent Number: 4,838,234

[45] Date of Patent: Jun. 13, 1989

[54] FREE-RUNNING PRESSURE WAVE SUPERCHARGER

[75] Inventor: Andreas Mayer, Niederrohrdorf, Switzerland

[73] Assignee: BBC Brown Boveri AG, Baden, Switzerland

[21] Appl. No.: 181,573

[22] Filed: Apr. 14, 1988

[30] Foreign Application Priority Data

Apr. 16, 1987 [CH] Switzerland ..... 1504/87

[51] Int. Cl.[4] ..... F02B 33/42

[52] U.S. Cl. ..... 123/559.2; 192/0.02 R; 417/64

[58] Field of Search ..... 123/559.2; 60/607, 608; 192/0.02 R; 318/759; 417/64

[56] References Cited

U.S. PATENT DOCUMENTS

| | | | |
|---|---|---|---|
| 2,399,394 | 4/1946 | Seippel . | |
| 2,654,991 | 10/1953 | Nettel | 60/608 X |
| 3,581,168 | 5/1971 | Kirkby | 318/759 |
| 3,822,768 | 7/1974 | Sebulke . | |
| 4,154,060 | 5/1979 | Deprez et al. . | |
| 4,368,708 | 1/1983 | Fried et al. . | |
| 4,527,534 | 7/1985 | Sakurai et al. . | |

FOREIGN PATENT DOCUMENTS

| | | | |
|---|---|---|---|
| 553633 | 12/1983 | Australia . | |
| 0014269 | 10/1981 | European Pat. Off. . | |
| 0028745 | 12/1983 | European Pat. Off. . | |
| 0105686 | 4/1984 | European Pat. Off. . | |
| 0151407 | 8/1985 | European Pat. Off. . | |
| 0020791 | 9/1985 | European Pat. Off. . | |
| 638367 | 11/1936 | Fed. Rep. of Germany | 60/607 |
| 1045526 | 12/1958 | Fed. Rep. of Germany . | |
| 1092551 | 11/1960 | Fed. Rep. of Germany . | |
| 2631257 | 1/1978 | Fed. Rep. of Germany . | |
| 3505613 | 8/1985 | Fed. Rep. of Germany . | |
| 2488330 | 2/1982 | France . | |
| 159340 | 8/1985 | Japan . | |
| 181043 | 2/1936 | Switzerland | 60/607 |
| 2086987 | 5/1982 | United Kingdom . | |

*Primary Examiner*—Michael Koczo

*Attorney, Agent, or Firm*—Burns, Doane, Swecker & Mathis

[57] ABSTRACT

Flanged onto the air casing (6) of a free-running pressure wave supercharger for an internal combustion engine is an electric motor (10*a*) whose shaft (28) is effectively connected to the rotor shaft (8) via a free-wheel overrunning clutch (9*a*) with engagement rollers (27) as the engagement bodies. In order to start a supercharged internal combustion engine, the electric motor (10*a*) accelerates the cell rotor (2) (in the case of a diesel engine, for example, during the short preheating period) to a rotational speed which ensures a functioning pressure wave process immediately after the diesel engine starts. The cell rotor (2) is then further accelerated by the exhaust gases of the diesel engine and then releases itself from the drive connection with the electric motor (10*a*), which has been put out of operation in the meantime.

1 Claim, 2 Drawing Sheets

FIG.1
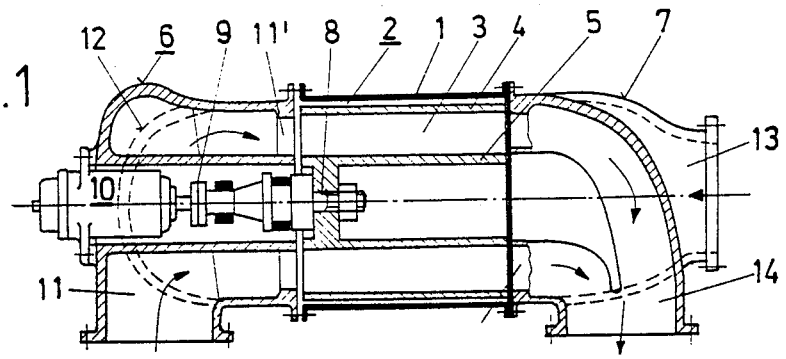
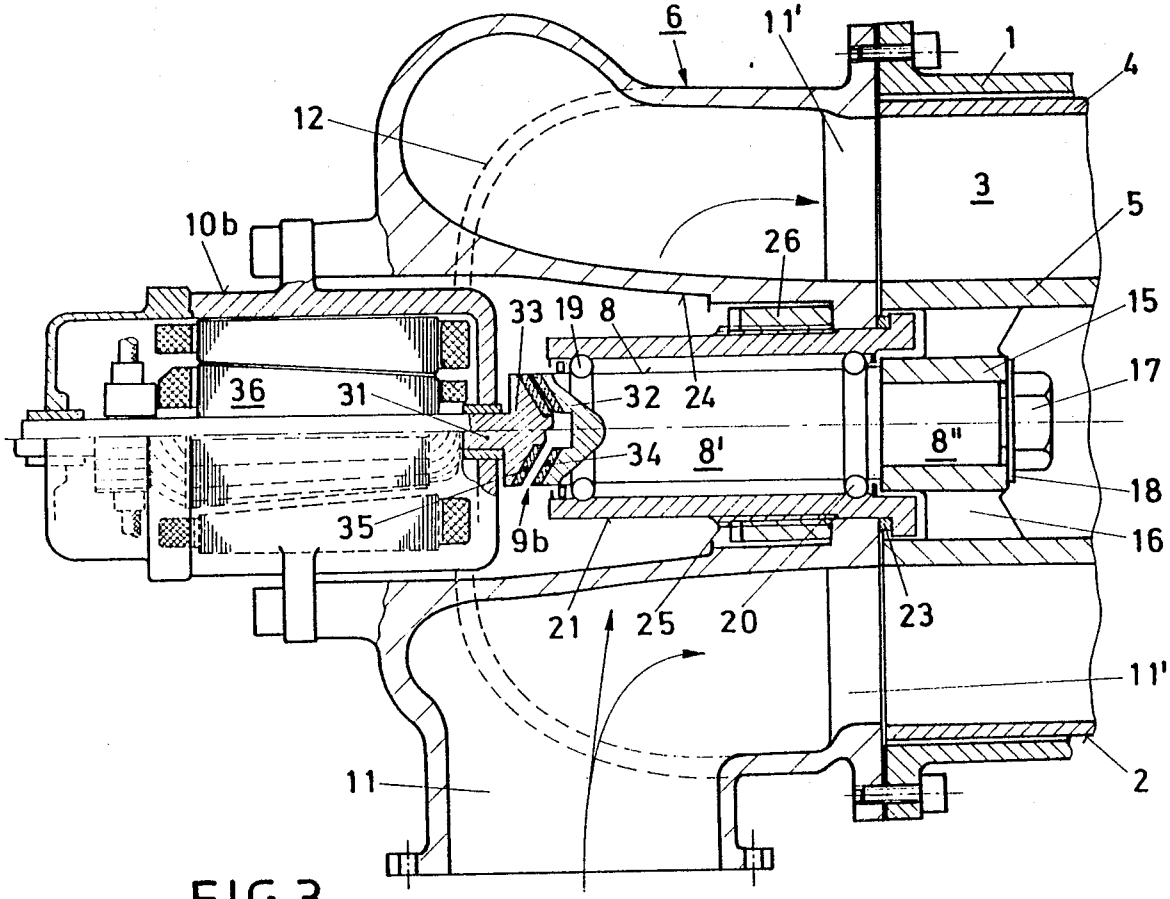
FIG.3

FREE-RUNNING PRESSURE WAVE SUPERCHARGER

BACKGROUND OF THE INVENTION

1. Field of the Invention

The present invention concerns a free-running pressure wave supercharger for an internal combustion engine, having a rotor casing, one end surface of which is closed by a gas casing—with an exhaust gas inlet duct for the supply of high pressure gas to a cell rotor and with an exhaust duct for the removal of low pressure gas from the cell rotor—and the other end surface of which is closed by an air casing—with an air induction duct for the supply of low pressure air into the cell rotor mentioned and with a supercharged air duct for the supply of the charge air compressed in the cell rotor to the internal combustion engine—the air casing having a bearing device for the rotor shaft of the cell rotor.

DISCUSSION OF BACKGROUND

In pressure wave superchargers used as the supercharging units for vehicles with internal combustion engines, the problem generally arises that driving off under load directly after a cold start is only possible by using an additional device which permits the engine to be operated as a naturally aspirated engine during this phase for such time as the pressure wave process is still unable to function satisfactorily because of the inadequate strength of the exhaust gas supply.

Such additional devices are automatic actuation devices for the supercharged air butterfly in the supercharged air pipe, together with a breather valve through which the engine draws the combustion air direct from the atmosphere when operating as a naturally aspirated engine during this cold starting phase. When the supercharged air butterfly is closed, this breather valve is opened by the engine in phase with the fluctuating induction depressions or is forced to stay open by an element dependent on the supercharged air butterfly and may possibly be locked in a closed position when the supercharged air butterfly is open, i.e. during supercharger operation. The actuation of the supercharged air butterfly preferably takes place by means of pneumatic servodevices, for example diaphragm capsules, which are subject to pressure differences of significant physical parameters in the pressure wave process and open the supercharged air butterfly once the intensity of these parameters necessary for satisfactory operation is reached. They then hold it open for the duration of the supercharger operation.

The above statement applies both to proportional drive pressure wave superchargers, which are positively driven by the engine at a constant gear ratio, preferably by a belt drive, and to free-running pressure wave superchargers, which are driven by the kinetic energy of the exhaust gases at a speed which is independent of the engine rotational speed. Compared with pressure wave superchargers with proportional drive, free-running pressure wave superchargers have the advantage that they offer more flexibility in the arrangement of the engine compartment because they are only connected to the exhaust gas manifold, whose placing permits a certain tolerance within the given space relationships. The installation position of a pressure wave supercharger positively driven by the engine, on the other hand, is—at least in the case of belt, chain or gearwheel drives, limited to a fairly narrow region around the drive elements for the auxiliaries.

Descriptions of starting aid devices, such as the supercharged butterfly automatic system mentioned, for positively driven pressure wave superchargers and of the problems which are associated with the operation of an internal combustion engine supercharged by a pressure wave supercharger during the starting phase, especially with a cold engine, are given in EP Patent Specifications Nos. 0,028,745, 0,014,269 and 0,020,791, U.S. Pat. Nos. 4,154,060 and 4,368,708 and in the applicant's DE-PS No. 2,631,257.

A free-running pressure wave supercharger driven by the gas forces of the internal combustion engine is known, for example, from the applicant's European Patent Application No. 87101608.5.

In free-running pressure wave superchargers the drive of the cell rotor is obtained partially from the nozzle-type design of the main and auxiliary ports in the gas and air casings and partially from the oblique or curved parts of the cell walls in the inlet region of the rotor cells. Tests have shown that the behavior of free-running pressure wave superchargers on hot engines in steady-state operation, and also during load changes, satisfies all the demands set for road vehicles. In these operating conditions, they exhibit—in contrast to exhaust gas turbochargers—the same advantages as pressure wave superchargers positively driven by the engine, notably including almost instantaneous response to increased supply of fuel when the load increases.

A disadvantage in the case of a free-running pressure wave supercharger, however, is that the full power is not immediately available for driving off in a vehicle after the starting of a cold engine. In this phase, the exhaust gas supplied by the engine is not sufficient to run up the rotor rapidly from rest in the desired manner. Particularly in the case of rotors cast in ferrous materials—and even in the case of rotors of lighter specific-weight ceramic materials with correspondingly smaller moments of inertia—the rotor's rotational speed does not increase sufficiently rapidly after a cold start and it therefore cannot immediately provide the supercharged air flow necessary for the full power of the engine.

SUMMARY OF THE INVENTION

The object of this invention is to avoid the previously described disadvantageous behavior of a free-running pressure wave supercharger for supercharging internal combustion engines during the cold starting phase. This means that the rotor of the supercharger must, immediately before the engine is started, have reached the rotational speed necessary for the pressure wave process to function. The rotor must therefore be accelerated from rest to a high rotational speed, approximately in the range between 4800 and 6000 rpm, before the engine is started. It has been shown by tests that a cold engine can be started without difficulty and without a starting valve or an automatic supercharged air butterfly even at substantially lower rotor rotational speeds, for example from about 3000 rpm. At this low rotor rotational speed, however, white smoke is formed for a short period when the vehicle is driven off. Operation is satisfactory, however, from the higher rotational speed range mentioned, within which the recirculation of exhaust gas into the engine is also reduced to acceptably low values.

It is therefore desirable to have an electric motor which, before the engine is started, brings the rotor into the rotational speed range mentioned, i.e. to about 5000 rpm, in 1 to 1.5 seconds. In the case of diesel engines, the preheating period before the engine is started is in any case sufficient for accelerating the rotor into this rotational speed range. The tests mentioned were carried out using a ceramic rotor. In order to achieve the same values with a rotor in a suitable metallic material with a correspondingly larger moment of inertia, a stronger electric motor is necessary than the one used in the tests mentioned. In both cases, a number of suitable permanently excited DC motors are available on the market for connection to the usual vehicle batteries.

The free-running pressure wave supercharger according to the invention has an electric motor fastened to the air casing and has, between the shaft of the electric motor and the free end of the rotor shaft, a clutch which provides a drive connection between the shaft of the electric motor and the rotor shaft when the electric motor is switched on and there is insufficient drive energy from the gas flow.

The invention is explained in greater detail below with reference to exemplary embodiments shown in the drawing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a diagrammatic representation of a freerunning pressure wave supercharger according to the invention, FIG. 3 shows a second embodiment with a conical friction clutch which can be switched off.

DESCRIPTION OF THE PREFERRED EMBODIMENTS

Figure 2:
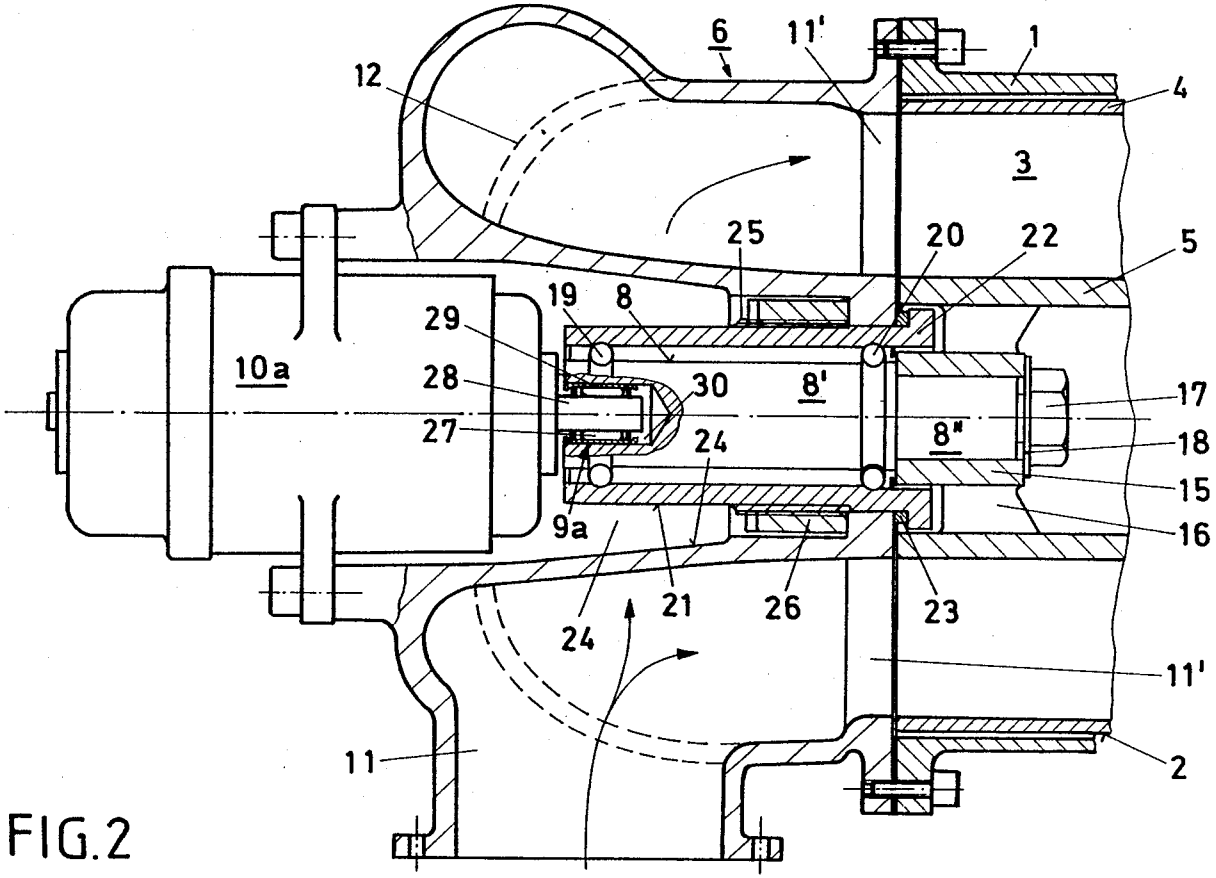
FIG. 2 shows a first embodiment with a free-wheel as the clutch, which can be switched off, between the rotor and the electric motor.

Referring now to the drawings, wherein like reference numerals designate identical or corresponding parts throughout the several views, in FIG. 1 the construction of the pressure wave supercharger is shown diagrammatically. A rotor casing 1 surrounds a conventional cell rotor 2 consisting of a number of rotor cells 3 evenly distributed around the periphery; these rotor cells 3 are bounded on the outside by a shroud 4 and on the inside by a hub tube 5. An air casing 6 is flanged onto the left-hand end of the rotor casing 1 and a gas casing 7 is flanged onto its right-hand end. The rotor 2 is rigidly connected to a rotor shaft 8 which is supported in the air casing 6 and can be brought into and out of drive connection with an electric motor 10 by means of a clutch 9. The ambient air to be compressed is induced into the rotor cells 3 via an air induction duct 11 and low pressure air ports 11' in the air casing 6 and, after compression in the rotor cells 3, is supplied via high pressure air ports (not shown) and a supercharged air duct 12 to an internal combustion engine, which is also not shown. The exhaust gases emerging from the engine enter the rotor cells 3 through an exhaust gas inlet duct 13 and high pressure gas ports (not shown) in the gas casing 7 and leave these rotor cells through low pressure gas ports 14' and an exhaust gas duct 14.

FIGS. 2 and 3 each show a longitudinal cross-section of the air casing 6 and a portion of the rotor casing 1.

As shown in FIGS. 2 and 3, the connection between the cell rotor 2 and the shaft 8, and the support of the cell rotor in the air casing 6 are identical as far as they relate to the corresponding clutch **9*a* or 9*b* respectively, which is located between the shaft 8 and the electric motor 10*a* or 10*b* respectively. The rotor 2 is seated by means of a hub sleeve 15, which is connected by ribs 16 to the hub tube 5 on a cylindrical spigot 8'' of the shaft 8, a bolt 17 clamping the shaft 8 frictionally against the hub sleeve 15 via a washer 18. The remaining part of the shaft 8, i.e. the bearing trunnion 8' is supported in two ball-bearings 19, 20 within a bearing bushing 21 which is firmly clamped in the air casing 6 on its end facing towards the rotor. The bearing bushing 21 has a collar 22 which is supported via a distance ring 23 against the flat end surface of the air casing 6 facing towards the rotor 2, in which end surface are located the control edges (not shown) of the low pressure air ports 11' for the supply of ambient air to the rotor cells and the high pressure air ports (not shown) for the removal of the compressed supercharged air from the cells 3 to the engine. The part of the bearing bushing 21 located in the shaft area 24 of the air casing is provided with an external thread 25 for a ring nut 26 which firmly clamps the bearing bushing 21 in the air casing 6**.

The clutch **9*a* of FIG. 2 is a commercially available free-wheel overrunning clutch of any known type; in the arrangement shown, it has cylindrical bearing needles or rollers as the engagement bodies 27, which run directly on the shaft stub 28 of the electric motor without any inner race and, when the electric motor is driving, are driven along by this shaft stub in the peripheral direction and are therefore frictionally engaged in a clamping gap formed by the shaft stub and engagement surfaces of the outer race 29 running obliquely to the peripheral direction. Because the outer race 29 has a press fit in the hole 30 of the shaft 8, it drives along the shaft 8—and hence also the cell rotor 2—with the rotational speed of the electric motor 10*a*. As soon as a rotational speed is reached which is sufficient for the pressure wave process to function, the motor 10*a* is switched off and the outer race 29 runs faster than the shaft of the electric motor so that the engagement bodies 27** are released from the clamping gaps and, in consequence, the rotor is now only driven more in a free-running mode by the internal combustion engine's exhaust gases alone.

The free-wheel overrunning clutch **9*a*** described above requires very little installation space because there is no inner race and this therefore permits a compact construction, economical in space, of the air casing and hence of the whole pressure wave supercharger. Other types of free-wheel overrunning clutches are, of course, also suitable for this purpose, for example those with inner races, those with clamping surfaces provided on the inner race instead of on the outer race, those with tipping bodies as engagement bodies and possibly also silent ratchets and the like adapted to this application.

FIG. 3 shows a second embodiment of the subject of the invention in a longitudinal section through the electric motor **10*b* and the clutch 9*b*. The clutch is a conical friction clutch, the hollow conical surface being provided in the rotor shaft 8 and the external conical surface being provided on the shaft stub 31 of a displacement armature design of motor 10*b* of known type. The clutch friction linings 34 and 35 of the concave clutch half 32 and the convex clutch half 33 are shown disengaged below the shaft axis and are shown in the engaged condition above the shaft axis. When no current is supplied to the motor 10***b*, its displacement armature 36 is displaced towards the left corresponding to the disengaged position of the convex clutch half. This is caused by a spring (not shown) in the motor casing. When the electricity is switched on, the conical displacement armature 36 is pulled to the right by magnetic forces, into the position shown above the shaft axis, against the resistance of the spring so that the two clutch halves 32, 33 come into engagement.

Relative to the free-wheel overrunning clutch 9*a* of FIG. 2, the conical friction clutch 9*b* has the advantage that when the engine is switched off, no relative motion can occur between the clutch parts so that it is only during the extremely short starting phase that a small amount of long-term wear could occur. With a sufficiently large displacement path of the armature 36 and a corresponding thickness of the friction linings, therefore, the life of the clutch should reach that of an internal combustion engine or even exceed it. If this should not be so in the case of a high switching frequency, relining the parts of the clutch should not be any problem because of the easily dismantled electric motor. Adjustment elements, for example axially screwed intermediate elements, could possibly be provided on one or both parts of the clutch in order to compensate for excessive clutch wear.

In addition to the two types of clutch described, others are, of course, also suitable—for example a friction clutch with flat friction linings or those with positive drive clutch halves. Electromagnetic devices can also be considered for the clutch actuation.

When using a relevant pressure wave supercharger in motor vehicles, the rolling contact bearings of the electric motor could, when at rest, be damaged by the impacts due to the internal combustion engine and road irregularities. These loads can cause plastic deformation on the rolling contact bearing elements. It may therefore be appropriate to keep the electric motor running during the whole of the time when the internal combustion engine is running at a more or less high rotational speed with the electric motor running slower than the rotor of the pressure wave supercharger. By this means, the favourable loading conditions of a rotating bearing are achieved. The electric motor is then expediently operated at a rotational speed from which, at idle, it can accelerate the supercharger rotor rapidly to a rotational speed at which the internal combustion engine can be prevented from stopping due to excessive recirculation. It can also be used to support the run-up of the supercharger rotor during rapid increases in load.

In order to shorten the generally long run-down of the rotor after the engine is switched off and to avoid the associated running noise when the vehicle is at rest, means can be provided on the electric motor to rapidly retard its armature. Possibilities for this purpose are, for example, reversing the polarity of the armature current or braking magnets.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the U.S. is:

1. Free-running pressure wave supercharger for an internal combustion engine, comprising: a rotor casing , one end surface of which is closed by a gas casing with an exhaust gas inlet duct for the supply of high-pressure gas to a cell rotor and with an exhaust duct for the removal of low-pressure gas from the cell rotor and the other end surface of which is closed by an air casing with an air induction duct for the supply of lowpressure air into the cell rotor and with a supercharged air duct for the supply of the charged air compressed in the cell rotor to the internal combustion engine , said air casing having bearing means for mounting a rotor shaft of the cell rotor, an electric motor mounted in the air casing a clutch which is operable to provide a drive connection between the shaft of the electric motor and the rotor shaft when the electric motor is switched on and there is insufficient drive energy from the gas flow, said clutch having a convex clutch member on the motor shaft and a concave clutch member on the rooter shaft, said clutch member clutch friction linings, said motor having an axial displacement armature for engaging said clutch members, and said electric motor includes means for retarding rotation of its armature after the current is switched off.

* * * * *